United States Patent [19]

Akutsu et al.

[11] Patent Number: 4,980,336

[45] Date of Patent: Dec. 25, 1990

[54] HEAT-SENSITIVE RECORDING MATERIAL

[75] Inventors: Mitsuo Akutsu; Syuji Iwakura; Keiji Tabata; Keiji Oya, all of Urawa, Japan

[73] Assignee: Adeka Argus Chemical Co., Ltd., Tokyo, Japan

[21] Appl. No.: 427,604

[22] Filed: Oct. 27, 1989

[30] Foreign Application Priority Data

Oct. 31, 1988 [JP] Japan ..... 63-275837

[51] Int. Cl.[5] ..... B41M 5/18

[52] U.S. Cl. ..... 503/209; 503/208; 503/225

[58] Field of Search ..... 427/150–152; 503/208, 209, 225

[56] References Cited

U.S. PATENT DOCUMENTS 4,601,863 7/1986 Shioi et al. ..... 503/213

FOREIGN PATENT DOCUMENTS 59-25674 6/1984 Japan ..... 503/209

*Primary Examiner*—Bruce H. Hess

*Attorney, Agent, or Firm*—Young & Thompson

[57] ABSTRACT

A heat-sensitive recording material wherein 1,2-bis(3,4-dimethylphenyl)ethane is contained as a sensitizer in a color-forming layer comprising a usually colorless or light-colored coupling substance and a developer which causes coloring of the coupling substance upon heating.

3 Claims, No Drawings

HEAT-SENSITIVE RECORDING MATERIAL

BACKGROUND OF THE INVENTION

1 [Field of the Invention]

The present invention relates to a heat-sensitive recording material. In particular, the present invention relates to a heat-sensitive recording material characterized by containing 1,2-bis(3,4-dimethylphenyl)ethane as sensitizer.

2 [Description of the Prior Art]

Heat-sensitive recording materials consist of a heat-sensitive color-forming layer comprising a dispersion of a sensitizer, binder and other additives in a coupling system comprising a usually colorless or light-colored coupling substance such as a leuco dye and a developer which causes coloring of the coupling substance upon heating, said layer being formed on a support such as paper, synthetic paper or resin film. When a heating element such as a thermal head or hot pen is brought into contact with the recording material in a recording device, the dye is reacted with the developer to develop a color such as black to thereby form a record.

The heat-sensitive recording materials are widely used in instrumental recorders, computers, facsimiles, telex devices, automatic passenger ticket vending machines, etc., since they are superior to other recording materials in that the records can be obtained in a short time, the noise is only slight and they are inexpensive.

As the colorless or light-colored coupling substances, for example, leuco dyes having a lactone, lactam or spiropyran ring are used. As the developers, various acidic substances have been proposed heretofore. Among them, phenolic compounds such as bisphenol A and benzyl p-hydroxybenzoate are frequently used either alone or in combination. However, when these phenols are used, increase of the recording speed and density is difficult, color shading is caused or discoloration occurs during the storage disadvantageously.

Under these circumstances, it was proposed to add a sensitizer to the coupling substance and developer to increase the sensitivity. As the sensitizers, waxes, dimethyl phthalate, stearamide, phenyl benzoate, terphenyl, bis(vinyloxyethoxy)-benzene and p-acetyloxybiphenyl were proposed.

However, these sensitizers are practically unsatisfactory, since they have defects that the effects of them cannot be sufficiently obtained unless they are used in a large amount, a high sensitization of the heat-sensitive recording material required thereof cannot be sufficiently satisfied, fogging is caused and discoloration occurs during the storage.

Japanese Patent Publication No. 25674/1984 discloses the use of an alkylated biphenyl or substituted biphenylalkane having a melting point of 60° to 200° C. as the sensitizer. It is also described therein that when such a sensitizer is used, a coupling sensitivity higher than that obtained when stearamide is used can be obtained. Suitable examples of the substituted biphenylalkanes described in the Publication are 1,2-bis(2,4-dimethylphenyl)ethane and 1,2-bis(2,4,5-trimethylphenyl)ethane.

However, even when such a compound is used, the effect is yet insufficient and practically unsatisfactory.

For example, although the coupling sensitivity is improved to some extent when 1,2-bis(2,4-dimethylphenyl)ethane is used, the storability is poor, fog is formed in the non-image area and the colored part is seriously discolored. When 1,2-bis(2,4,5-trimethylphenyl)ethane is used, the coupling sensitivity is quite low and the discoloration in the colored area is disadvantageously severe, though the fogging in the non-image area is slight.

SUMMARY OF THE INVENTION

After intensive investigations made for the purpose of overcoming the above-described defects, the inventors have found that when 1,2-bis(3,4-dimethylphenyl)ethane is used, not only an excellent coupling sensitivity can be obtained but also the storability can be remarkably improved as compared with those of a case wherein a conventional compound is used. The present invention has been completed on the basis of this finding.

The present invention provides a heat-sensitive recording material having formed on an underlying support a color-forming layer comprising a usually colorless or light-colored coupling substance and a developer which causes coloring of the coupling substance upon heating, characterized in that the color-forming layer contains 1,2-bis(3,4-dimethylphenyl)ethane.

DETAILED DESCRIPTION OF THE INVENTION

Although 1,2-bis(3,4-dimethylphenyl)ethane used in the present invention has a chemical structure quite similar to that of 1,2-bis(2,4-dimethylphenyl)ethane or 1,2-bis(2,4,5-trimethylphenyl)ethane described in the above-described Japanese Patent Publication No. 25674/1984, the former is different from the latter in that the former remarkably improves the coupling sensitivity and storability. A quite particular effect can be obtained by using 1,2-bis(3,4-dimethylphenyl)-ethane.

Although the mechanism producing the excellent effects of 1,2-bis(3,4-dimethylphenyl)-ethane used in the present invention, which cannot be supposed from 1,2-bis(2,4-dimethylphenyl)ethane or 1,2-bis(2,4,5-trimethylphenyl)ethane having a similar chemical structure, has not been elucidated yet, supposedly such a difference results from differences in the size, number and position of the substituents and affinity thereof for the dye.

1,2-Bis(3,4-dimethylphenyl)ethane used in the present invention is a known compound which can be easily produced by, for example, reacting o-xylene with 1,2-dichloroethane as described in Japanese Patent Publication No. 29137/1971.

Various dyes are known as the usually colorless or light-colored coupling substances. The coupling substances used in the present invention are not particularly limited so far as they are usually used for producing ordinary pressure-sensitive recording papers or heat-sensitive recording papers.

Examples of the coupling substances usable in the present invention include (1) triarylmethane compounds such as 3,3-bis(p-dimethylaminophenyl)-6-dimethylaminophthalide (Crystal Violet Lactone), 3-(p-dimethylaminophenyl)-3-(1,2-dimethyl-3-indolyl)-phthalide, 3-(p-dimethylaminophenyl)-3-(2-phenyl-3-indolyl)phthalide, 3,3-bis(9-ethyl-3-carbazolyl)-5-dimethylaminophthalide and 3,3-bis(2-phenyl-3-indolyl)-5-dimethylaminophthalide;

(2) diphenylmethane compounds such as 4,4-bis(-dimethylamino)benzhydrin benzyl ether and N-2,4,5-trichlorophenylleucoauramine;

(3) xanthene compounds such as Rhodamine-β-anilinolactam, 3-dimethylamino-7-methoxyfluoran, 3-dimethylamino-6-methoxyfluoran, 3-diethylamino-7-methoxyfluoran, 3-dimethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-6-methyl-7-xylidinofluoran, 3-diethylamino-7-N-chloroethyl-N-methylaminofluoran, 3-diethylamino-7-N-diethylaminofluoran, 3-(N-ethyl-p-toluidino)-6-methyl-7-(p-toluidino)fluoran, 3-diethylamino-7-octylaminofluoran, 3-diethylamino-7-(2-chloroanilino) fluoran, 3-diethylamino-6-methyl-7-anilinofluoran, 3-diethylamino-6-chloro-7-(β-ethoxyethylamino)fluoran, 3-diethylamino-7-(2-carbomethoxyphenylamino)fluoran, 3-(N-ethyl-N-isoamylamino)-6-methyl-7-anilinofluoran, 3-(N-methyl-N-n-amylamino)-6-methyl-7-anilinofluoran, 3-(N-ethyl-N-n-amylamino)-6-methyl-7-anilinofluoran, 3-(N-methyl-N-n-hexylamino)-6-methyl-7-anilinofluoran, 3-(N-ethyl-N-n-hexylamino)-6-methyl-7-anilinofluoran, 3-(N-ethyl-N-β-ethylhexylamino)-6-methyl-7-anilinofluoran, 3-dibutylamino-6-methyl-7-anilinofluoran, 3-dibutylamino-7-(2-chloroanilino)fluoran, 3-piperidino-6-methyl-7-anilinofluoran, 3-(N-ethyl-p-toluidino)-6-methyl-7-anilinofluoran, 3-pyrrolidino-6-methyl-7-anilinofluoran, 3-pyrrolidino-6-methyl-7-p-butylphenylaminofluoran, 3-(N-cyclohexyl-N-methylamino)-6-methyl-7-anilinofluoran, 3-(N-isopropyl-N-ethylamino)-6-methyl-7-anilinofluoran and 3-diethylamino-6-chloro-7-65 -chloropropylaminofluoran;

(4) thiazine compounds such as benzoyl leuco methylene blue and p-nitrobenzoyl leuco methylene blue; and (5) spiro compounds such as 3-methylspirodinaphthopyran, 3-ethylspirodinaphthopyran, 3-benzylspirodinaphthopyran and 3-methylnaphtho(3-methoxybenzo)spiropyran.

These coupling substances (dyes) can be used either singly or in the form of a mixture of two or more of them.

The developers usable in the present invention include, for example, phenols such as p-octylphenol, p-tert-butylphenol, p-phenylphenol, p-hydroxyacetophenone, α-naphthol, β-naphthol, p-tert-octylcatechol, 2,2'-dihydroxybiphenyl, bisphenol A, 1,1-bis(p-hydroxyphenyl)butane, 2,2-bis(4-hydroxyphenyl)heptane, 2,2-bis(3-methyl-4-hydroxyphenyl)propane, 2,2- bis(3,5-dimethyl-4-hydroxyphenyl)propane, 2,2-bis(3,5-dichloro-4-hydroxyphenyl)propane, bis(4-hydroxyphenyl) sulfone, bis(3,4-dihydroxyphenyl) sulfone, bis(4-allyl-4-hydroxyphenyl) sulfone, 4-hydroxy-4'-isopropoxydiphenyl sulfone, 1,1-bis(4-hydroxyphenyl)cyclohexane, bis(4-hydroxyphenyl) ether, p-hydroxybenzoic acid, ethyl p-hydroxybenzoate, butyl p-hydroxybenzoate, benzyl p-hydroxybenzoate, butyl bis(4-hydroxyphenyl)acetate, 1,1,3-tris(2-methyl-4-hydroxy-5-tert-butylphenyl)butane, 1,1,3-tris(2-methyl-4-hydroxy-5-cyclohexylphenyl)butane, bis[2- 4-hydroxyphenylthio)ethoxy]methane and dimethyl 4-hydroxyphthalate; aliphatic carboxylic acids such as oxalic, maleic, tartaric, citric, succinic, stearic and behenic acids; aromatic carboxylic acids such as benzoic, tert-butylbenzoic, phthalic, gallic, salicylic, isopropylsalicylic, phenylsalicylic, 3,5-di-tert-butylsalicylic, 3-methyl-5-benzylsalicylic, 3,5-di(α-methylbenzyl)salicylic and 3-phenyl-5-(α,α-dimethylbenzyl)salicylic acids and polyvalent metal salts of these aromatic carboxylic acids, such as zinc, magnesium, aluminum, calcium, titanium, manganese, tin and nickel salts of them; and inorganic developers such as acid clay, activated clay, attapulgite, bentonite, colloidal silica, aluminum silicate, magnesium silicate, zinc silicate, tin silicate, calcined kaolin and talc.

1,2-Bis(3,4-dimethylphenyl)ethane and the coupling substance and developer used in the present invention are finely ground with a grinding machine such as a ball mill, atomizer or sand grander and, if necessary, additives are added thereto to form a coating suspension.

The coating suspension usually contains a binder such as polyvinyl alcohol, hydroxyethylcellulose, methylcellulose, polyacrylamide, starch, styrene/maleic anhydride copolymer, vinyl acetate/maleic anhydride copolymer, styrene/butadiene copolymer or modifications of them, and a filler such as silane, kaolin, diatomaceous earth, talc, titanium dioxide, calcium carbonate, magnesium carbonate, aluminum hydroxide or melamine.

Further, metallic soaps, amides, waxes, light stabilizers, waterproofing agents, dispersants and antifoaming agents can also be used. Particularly the sensitivity and storability are often improved by using a zinc soap such as zinc stearate and an amide such as stearamide.

The coating suspension is applied to the paper or the film to form the intended heat-sensitive recording material.

The amount of 1,2-bis(3,4-dimethylphenyl)ethane used in the present invention is not particularly limited, since it varies depending on the necessary properties, suitability for the recording, and kinds and amounts of other additives used. However, it is usually 0.1 to 10 parts by weight per part by weight of the coupling substance.

Preferred proportions of the components constituting the color-forming layer of the heat-sensitive recording material of the present invention are as follows: 3 to 30% by weight of the coupling substance (leuco dye), 3 to 40% by weight of the developer, 3 to 40% by weight of 1,2-bis(3,4-dimethylphenyl)ethane (sensitizer) and the balance of the binder (resin component), filler, lubricant, etc.

The following Examples will further illustrate the present invention.

Example 1

20 g of 3-(N-ethyl-N-isopropylamino)-6-methyl-7-anilinofluoran and 100 g of a 10% aqueous polyvinyl alcohol solution were sufficiently milled to obtain a dye dispersion (dispersion A).

20 g of bisphenol A and 100 g of a 10% aqueous polyvinyl alcohol solution were sufficiently milled to obtain a developer dispersion (dispersion B).

20 g of a sample compound listed in the following Table 1 and 100 g of a 10% aqueous polyvinyl alcohol solution were sufficiently milled to obtain a dispersion (dispersion C).

20 g of zinc stearate and 100 g of a 10% aqueous polyvinyl alcohol solution were sufficiently milled to obtain a dispersion (dispersion D).

The dispersions A, B, C and D and finely pulverized silica were mixed in a weight ratio of 2:2:0.4:0.5 to obtain a homogeneous coating dispersion.

The coating dispersion was applied to a paper support (basis weight : 50 g/m$^2$) to form a layer having a thickness of 28 μm, which was dried to obtain a heat-sensitive recording material (heat-sensitive paper).

After printing on the heat-sensitive paper thus obtained while varying the pulse width with a heat-sensitive printer (TH-PMD; a product of Ohkura Electric Co., Ltd.), the color density of the recorded image was determined with a Macbeth densitometer (RD-933; a product of Macbeth Co.).

Then the color-developed heat-sensitive paper was kept at a relative humidity of 90% at a temperature of 70° C. for 2 h and then at 70° C. under dry condition for 8 h to examine fogging of the non-image area and changes in the density of the color-developed area. Further DOP was stamped on the color-developed area (pulse width: 1 msec) and was kept at 70° C. under dry condition for 8 h to examine changes in the density thereof.

The results are shown in Table 1.

TABLE 1

| Sample compound | Pulse width (msec) | Initial density | Storability | | |
|---|---|---|---|---|---|
| | | | Wet heat | Dry | oil resistance |
| m-Terphenyl | 1.0 | 1.16 | 1.01 | — | 0.58 |
| (Comparative | 0.6 | 1.08 | 0.80 | 0.98 | — |
| example) | 0.4 | 0.46 | 0.51 | 0.53 | — |
| | non-image area | 0.08 | 0.28 | 0.31 | — |
| 1,2-Bis(2,4- | 1.0 | 1.21 | 1.01 | — | 0.82 |
| dimethylphenyl)- | 0.6 | 1.10 | 0.69 | 1.00 | — |
| ethane | 0.4 | 0.61 | 0.41 | 0.48 | — |
| (Comparative example) | non-image area | 0.11 | 0.31 | 0.29 | — |
| 1,2-Bis(2,4,5- | 1.0 | 0.97 | 1.08 | — | 0.99 |
| trimethylphenyl) | 0.6 | 0.78 | 1.05 | 1.04 | — |
| ethane | 0.4 | 0.14 | 0.31 | 0.28 | — |
| (Comparative example | non-image area | 0.08 | 0.12 | 0.11 | — |
| 1,2-Bis(3,4- | 1.0 | 1.22 | 1.26 | — | 1.23 |
| dimethylphenyl)- | 0.6 | 1.18 | 1.20 | 1.21 | — |
| ethane | 0.4 | 0.59 | 0.56 | 0.59 | — |

TABLE 1-continued

| Sample compound | Pulse width (msec) | Initial density | Storability | | |
|---|---|---|---|---|---|
| | | | Wet heat | Dry | oil resistance |
| (Present invention) | non-image area | 0.08 | 0.10 | 0.10 | — |

It is apparent from the results shown in Table 1 that when m-terphenyl is used, the coupling sensitivity is relatively excellent, but the storability is poor, the fogging and oil resistance are quite poor and the discoloration of the color-developed area is serious. When 1,2-bis(2,4-dimethylphenyl)ethane analogous to 1,2-bis(3,4-dimethylphenyl)ethane of the present invention is used, the coupling sensitivity is excellent, but the fogging and discoloration in the color-developed area are serious. When 1,2-bis(2,4,5-trimethylphenyl)ethane is used, the fogging is tolerable, but the coupling sensitivity is utterly insufficient and the discoloration in the color-developed area after storage is serious.

On the contrary, the heat-sensitive recording material of the present invention containing 1,2-bis(3,4-dimethylphenyl)ethane exhibits a remarkable coupling sensitivity and only slight fogging in the non-image area and discoloration in the color-developed area after storage. Thus the heat-sensitive recording material of the present invention is quite excellent.

What is claimed is:

1. A heat-sensitive recording material having a color-forming layer formed on an underlying support, said color-forming layer comprising a usually color-less or light-colored coupling substance and a developer which causes coloring of the coupling substance upon heating, wherein the color-forming layer contains 1,2-bis(3,4-dimethylphenyl)ethane.

2. A heat-sensitive recording material as set forth in claim 1, wherein the amount of 1,2-bis(3,4-dimethylphenyl)ethane is 0.1 to 10 parts by weight per part by weight of the coupling substance.

3. A heat-sensitive recording material as set forth in claim 1, wherein the underlying support comprises paper, synthetic paper or resin film.

* * * * *